US005088718A

United States Patent [19]

Stepan et al.

[11] Patent Number: 5,088,718

[45] Date of Patent: Feb. 18, 1992

[54] HIGH CAPACITY SHEET FEEDER

[75] Inventors: Constance R. Stepan; James A. Spiers, both of Derby, Conn.

[73] Assignee: Pitney Bowes Inc., Stamford, Conn.

[21] Appl. No.: 622,906

[22] Filed: Dec. 6, 1990

[51] Int. Cl.[5] ..... B65H 1/00

[52] U.S. Cl. ..... 271/161; 271/121; 271/149

[58] Field of Search ..... 271/161, 149, 167, 160, 271/37, 114, 116, 121, 123, 124, 125, 126, 10, 12, 16, 21, 22

[56] References Cited

U.S. PATENT DOCUMENTS

| | | | |
|---|---|---|---|
| 1,047,689 | 12/1912 | Nind et al. . | |
| 1,566,163 | 12/1925 | Neihart . | |
| 4,184,670 | 1/1980 | Rosendahl | 271/12 |
| 4,352,022 | 9/1982 | Britton | 271/149 X |
| 4,362,100 | 12/1982 | Wu et al. | 101/233 |
| 4,671,504 | 6/1987 | Lapinski et al. | 271/161 X |

*Primary Examiner*—David H. Bollinger
*Attorney, Agent, or Firm*—Charles R. Malandra, Jr.; David E. Pitchenik; Melvin J. Scolnick

[57] ABSTRACT

Apparatus for feeding and separating seriatim a sheet of paper from a stack of sheets. The apparatus includes: a deck having a receiving end and a feeding end for supporting the stack of sheets on edge, the deck oriented at an angle between about 10 and 20 degrees to a horizontal plane and wherein the feeding end is lower than the receiving end; a main urge roller situated above the feeding end of the deck at about midway between the top and bottom edges of the stack of sheets, whereby the stack is bent at a point in the sheets about midway between the top and bottom edges of the sheets; a secondary feed roller parallel to and situated above the main urge roller near the top edge of the stack of sheets, wherein a line of tangency joining the peripheries of the main urge roller and the feed roller adjacent the stack of sheets is disposed at an angle between about 40 and 50 degrees to a horizontal plane; a device for urging the stack against the main urge roller as the stack is reduced in the course of the feeding of the sheets seriatim; and a device downstream of the secondary feed roller for separating the bottom sheet from the stack of sheets at the top edge of the stack.

7 Claims, 2 Drawing Sheets

HIGH CAPACITY SHEET FEEDER

The instant invention relates to apparatus for feeding and separating sheets of paper from a stack of sheets, and more particularly to such a sheet feeder having a large, loading capacity.

Sheet feeders take sheets from a stack, one unit at a time, and find practical use in connection with systems where a sheet of paper is to be put into an envelope. Usually, the sheets of paper are stacked in a unit and manually placed in a holding device. From this holding device the sheets are conveyed in one way or another to the envelope, where they are inserted into the envelope by machine. This insertion is desired to be performed as quickly and as safely as possible.

Stacks for feeding sheets can be oriented in a variety of directions to achieve particular, desired objectives. Feeding from the bottom of a stack offers the advantage of a constant feed location not requiring any supplemental devices to position the sheet being fed. However, typically there is a limit to the size of a stack that can be used for bottom feeding because at a certain point the pressure and weight becomes too great for effective, efficient feeding and separation.

Thus, the instant invention achieves the advantages of bottom feeding but without the limitation of small loading capacity usually associated with bottom feeding.

SUMMARY OF THE INVENTION

Accordingly, the instant invention provides apparatus for feeding and separating seriatim a sheet of paper from a stack of sheets. The apparatus comprises: a deck having a receiving end and a feeding end for supporting said stack of sheets on edge, said deck oriented at an angle between about 10 and 20 degrees to a horizontal plane and wherein said feeding end is lower than said receiving end; a main urge roller situated above the feeding end of the deck at about midway between the top and bottom edges of the stack of sheets, whereby the stack is bent at a point in the sheets about midway between the top and bottom edges of the sheets; a secondary feed roller parallel to and situated above the main urge roller near the top edge of the stack of sheets, wherein a line of tangency joining the peripheries of the main urge roller and the feed roller adjacent the stack of sheets is disposed at an angle between about 40 and 50 degrees to a horizontal plane; means for urging the stack against the main urge roller as the stack is reduced in the course of the feeding of the sheets seriatim; and means downstream of the secondary feed roller for separating the bottom sheet from the stack of sheets at the top edge of the stack.

DETAILED DESCRIPTION OF THE PREFERRED EMBODIMENT

Figure 1:
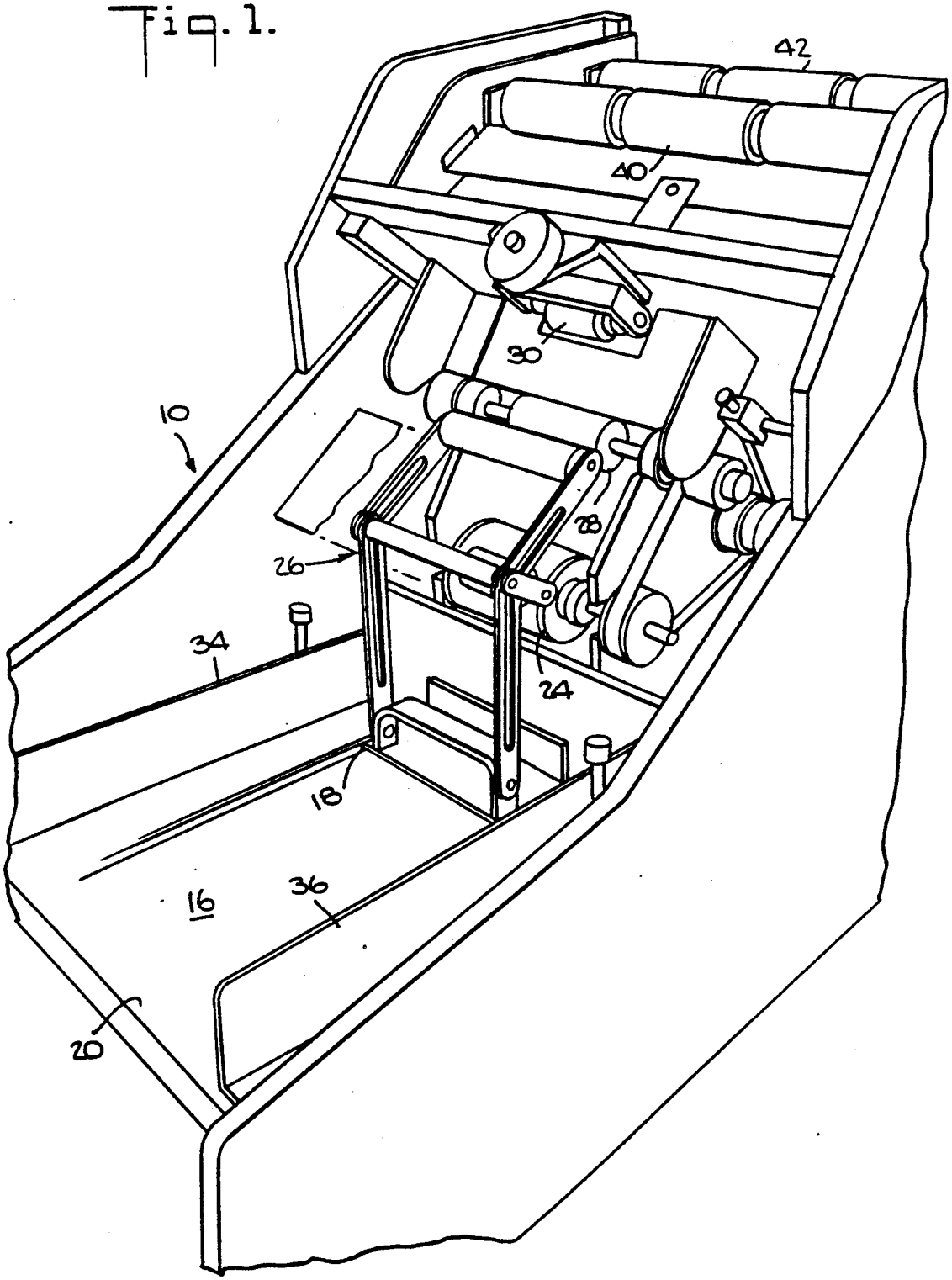
FIG. 1 is a perspective view of a high capacity sheet feeder in accordance with the instant invention.
Figure 2:
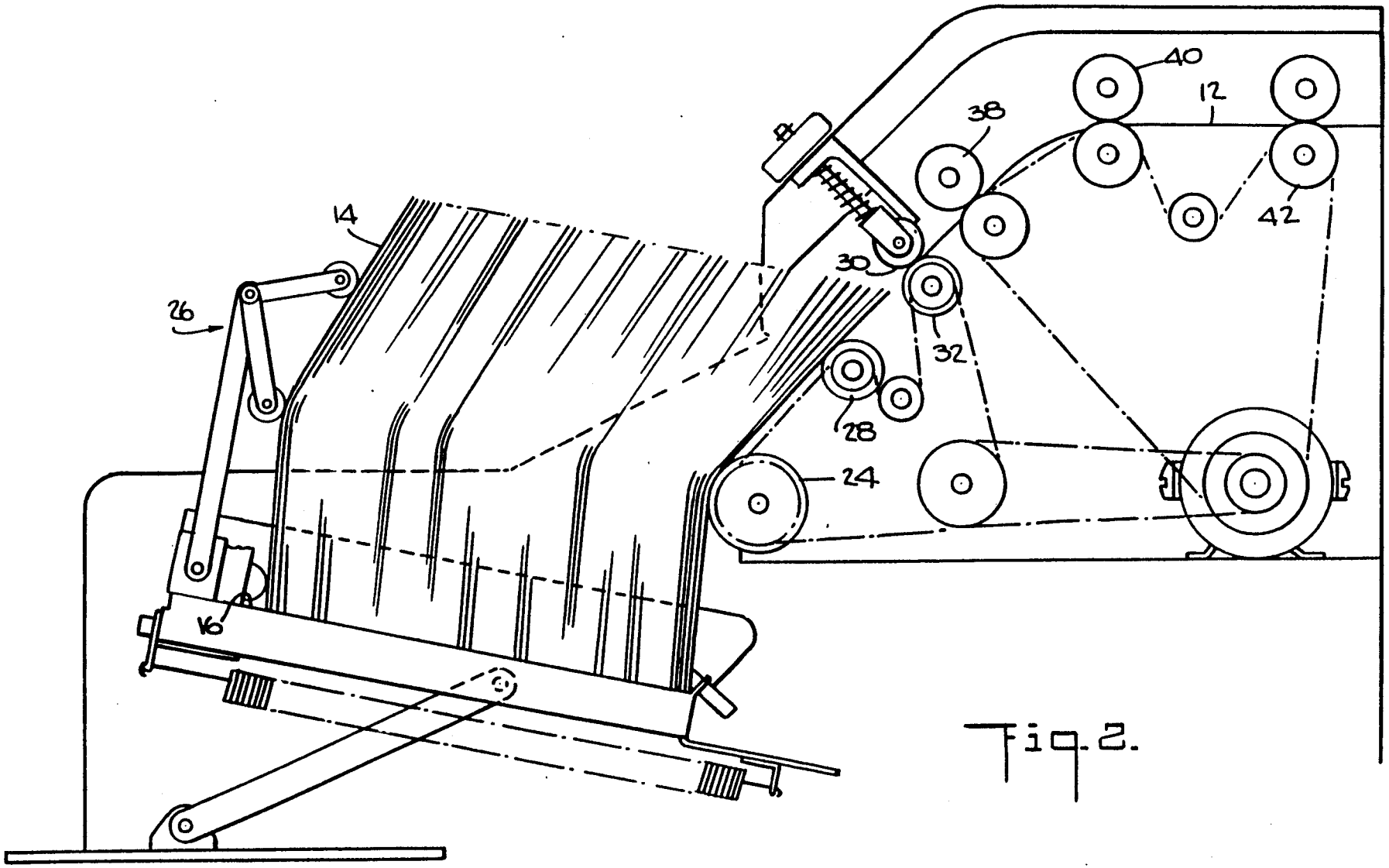
FIG. 2 is a side, elevational view of the high capacity sheet feeder seen in FIG. 1.

In describing the preferred embodiment of the instant invention, reference is made to the drawings, wherein there is seen a sheet feeding and separating device generally designated 10 for feeding and separating seriatim a sheet of paper 12 from a stack of sheets 14 (see FIG. 2). The sheet feeder 10 includes a deck 16 which is oriented at an angle of 15° to the horizontal in order to support the stack of sheets 14 on edge. The lower end of the deck 16 is the feeding end 18, while the higher end of the deck 16 is the receiving end 20. The entire stack of sheets 14 bends at a 43° angle over a main urge roller 24 (as explained further hereinbelow). This orientation allows a large loading capacity with minimal influence of stack pressure at separation points. Most of the stack weight distributes on the deck 16. Natural separation begins after the bend by a slight fanning of the stack 14 at the top.

The deck 16 sits at the aforementioned 15° slant mounted by a linkage system shown in FIG. 2. Because of the slant, gravity maintains a positive force at the feeding end of the stack of sheets 14. A spring loaded guide 26 contacts the stack 14 at the receiving end (back) along the bottom, at the bending point and close to the top. The spring guide 26 advances the entire stack 14 forward toward the main urge roller 24 a the stack 14 decreases. When the stack 14 becomes very small, extra force on the stack 14 is needed to feed the last sheets 12, and the guide 26 supplies the needed force. The guide 26 is also necessary to support longer sheets 12 in the correct position.

The main urge roller 24 is situated above the feeding end 18 of the deck 16 along a line which is at about the midway point between the top and bottom edges of the stack of sheets 14. A secondary feed roller 28 is parallel to and situated above the main urge roller 24 near the top edge of the stack of sheets 14. A line of tangency joining the peripheries of the main urge roller 24 and the secondary feed roller 28 adjacent the stack of sheets 14 is disposed at a 43 degree angle to the horizontal, i.e. this line of tangency is parallel to the plane of the protective plate 22. The stack of sheets 14 rests against the main urge roller 24 and the secondary feed roller 28, and thus lies at a 43 degree angle to the horizontal.

Separation of a sheet 12 from the stack of sheets 14 is effected by the main urge roller 24, the secondary feed roller 28 and a cooperating stone 30 and feed roller 32. Adjustable side guides 34 and 36 force the sheets 12 to run in a straight path. A clutch controls the stopping and starting of the rollers.

Following separation at the stone 30, the sheets 12 enter a removal section consisting of three long roller sets 38, 40 and 42, where the paper path curves to a horizontal position, preparatory for further processing.

One motor (not shown) drives the entire sheet feeder 10; the removal section consisting of the roller sets 38, 40 and 42 runs continuously, while the separation section consisting of the main urge roller 24, the secondary roller 28, the stone 30 and the cooperating feed roller 32 feeds upon demand.

In operating the aforesaid sheet feeding apparatus 10, the sheets 12 are loaded onto the deck 16 so that the stack 14 is formed against the rollers 24 and 28. The side guides 34 and 36 keep the stack 14 in line. A clutch engages the separation section and the rollers 24, 28 and 32 all start. Because the top of the stack 14 is slightly fanned, little friction is present between individual sheets 12 there. Friction between the main urge roller 24 and the paper 12 is greater than between two pieces of paper 12 at the bending point. The main urge roller 24 forces the paper 12 up towards the stone 30. Gravity aids in keeping the remaining sheets 12 in the stack 14 in place. A pre-set gap between the stone 30 and the roller 32 allows only one sheet of paper 12 into the nip therebetween.

After one sheet 12 is through the stone 30 and into the nip of the take away rollers 38, the clutch disengages. The take away rollers 38 are running at a higher speed and they pull the sheet 12 away from the stack 14. The roller 32 under the stone 30 contains a one way bearing to eliminate drag. The main urge roller 24 becomes stationary and holds the remaining sheets 12 in place. After the sheet 12 exits and the system is ready, the clutch engages again and another sheet 12 feeds.

Although the deck 16 is seen as oriented at an angle of 15°, a range between 10° and 20° is functional, although a more limited range between 12° and 18° is preferred. The tangency line between the rollers 24 and 28 is seen as oriented at an angle of 43° to the horizontal, and although a range of 40° to 50° is functional, a more limited range between 42° and 47° is preferred.

It should be understood by those skilled in the art that various modifications may be made in the present invention without departing from the spirit and scope thereof, described in the specification and defined in the appended claims.

What is claimed is:

1. Apparatus for feeding and separating seriatim a sheet of paper from a stack of sheets, comprising:

a deck having a receiving end and a feeding end for supporting said stack of sheets on edge, said deck oriented at an angle between about 10 and 20 degrees to a horizontal plane and wherein said feeding end is lower than said receiving end;

a main urge roller situated above said feeding end of said deck at about midway between the top and bottom edges of said stack of sheets, whereby said stack is bent at a point in the sheets about midway between the top and bottom edges of said sheets;

a secondary feed roller parallel to and situated above said main urge roller near the top edge of said stack of sheets, wherein a line of tangency joining the peripheries of said urge roller and said feed roller adjacent said stack of sheets is disposed at an angle between about 40 and 50 degrees to a horizontal plane;

means for urging said stack against said main urge roller as said stack is reduced in the course of said feeding of said sheets seriatim; and means downstream of said secondary feed roller for separating the bottom sheet from said stack of sheets at the top edge of said stack.

2. The apparatus of claim 1, wherein said urging means comprises a spring loaded guide.

3. The apparatus of claim 2, wherein said separating means comprises a separating stone and cooperating feed roller.

4. The apparatus of claim 3, wherein said deck angle is between about 12 and 18 degrees.

5. The apparatus of claim 4, wherein said deck angle is 15 degrees.

6. The apparatus of claim 4, wherein said angle of said line of tangency is between about 42 and 47 degrees.

7. The apparatus of claim 6, wherein said angle of said line of tangency is 43 degrees.

* * * * *